US012024334B2

(12) United States Patent
Nowak et al.

(10) Patent No.: US 12,024,334 B2
(45) Date of Patent: Jul. 2, 2024

(54) CORNER ELEMENT FOR A CAGE-LIKE STRUCTURE AND A CAGE-LIKE STRUCTURE PROVIDED WITH SUCH CORNER ELEMENTS

(71) Applicant: NEFAB AB, Jönköping (SE)

(72) Inventors: David Nowak, Hasselt (BE); Hans Nelen, Son en Breugel (NL)

(73) Assignee: Nefab AB, Jönköping (SE)

( * ) Notice: Subject to any disclaimer, the term of this patent is extended or adjusted under 35 U.S.C. 154(b) by 981 days.

(21) Appl. No.: 16/975,881

(22) PCT Filed: Feb. 26, 2019

(86) PCT No.: PCT/SE2019/050171
§ 371 (c)(1),
(2) Date: Aug. 26, 2020

(87) PCT Pub. No.: WO2019/168459
PCT Pub. Date: Sep. 6, 2019

(65) Prior Publication Data

US 2021/0002025 A1 Jan. 7, 2021

(30) Foreign Application Priority Data

Feb. 28, 2018 (SE) ..... 1850225-2

(51) Int. Cl.
*B65D 19/38* (2006.01)
*B65D 19/16* (2006.01)

(52) U.S. Cl.
CPC ..... *B65D 19/385* (2013.01); *B65D 19/16* (2013.01); *B65D 2519/00029* (2013.01);
(Continued)

(58) Field of Classification Search
CPC ..... B65D 2519/00611; B65D 19/16; B65D 19/38; B65D 71/04; Y10S 229/92
(Continued)

(56) References Cited

U.S. PATENT DOCUMENTS 3,104,024 A * 9/1963 Eberly ..... B65D 19/16 217/12 R
5,722,551 A * 3/1998 Cocciemiglio, Jr. .... B65D 9/24 220/4.33

(Continued)

FOREIGN PATENT DOCUMENTS

CN 100358780 C * 1/2008 ..... B65D 19/16
CN 206520843 U * 9/2017

(Continued)

OTHER PUBLICATIONS

Translation of CN-100358780-C (Year: 2008).*
Translation of WO-2015071296-A1 (Year: 2015).*

*Primary Examiner* — Mollie Impink
(74) *Attorney, Agent, or Firm* — Dilworth & Barrese, LLP

(57) ABSTRACT

The invention relates to an element (1) to be arranged in a corner of a parallelepipedic cage-like structure where a bottom or a top plane of the structure meets two walls of the structure extending perpendicularly to this plane and to each other. The element (1) comprises a bottom portion (2), outer wall portions (6, 7), inner wall portions (9, 10) and wall members (16, 17) so as to receive components of said structure in the form of first and second board-like members, such as wooden planks, therebetween with wide sides of these board-like members bearing on each other. The inner wall portions (9, 10) each comprises a spring member (90, 100) configured to bear onto and urge a said second board-like member to press a said first board-like member against an outer wall portion (6, 7), so as to clamp these board-like
(Continued)

members between a couple of inner (9, 10) and outer (6, 7) wall portions. The invention also relates to a cage-like structure provided with such elements (1) at said corners thereof.

14 Claims, 3 Drawing Sheets

(52) U.S. Cl.
CPC ..... *B65D 2519/00064* (2013.01); *B65D 2519/00273* (2013.01); *B65D 2519/00323* (2013.01); *B65D 2519/00333* (2013.01); *B65D 2519/00432* (2013.01); *B65D 2519/00502* (2013.01); *B65D 2519/00611* (2013.01)

(58) Field of Classification Search
USPC ..... 220/4.33
See application file for complete search history.

(56) References Cited

U.S. PATENT DOCUMENTS

| | | | | |
|---|---|---|---|---|
| 2013/0186889 | A1* | 7/2013 | Meyer-Horn | B65D 88/123 217/65 |
| 2014/0021090 | A1* | 1/2014 | Meyer-Horn | B65D 19/16 206/600 |

FOREIGN PATENT DOCUMENTS

| | | | | |
|---|---|---|---|---|
| CN | 206520843 | U | 9/2017 | |
| FR | 2848988 | A1 | 6/2004 | |
| FR | 3010707 | A1 | 3/2015 | |
| GB | 2348688 | A * | 10/2000 | B65D 11/1873 |
| WO | WO-2015071296 | A1 * | 5/2015 | B65D 19/16 |

* cited by examiner

CORNER ELEMENT FOR A CAGE-LIKE STRUCTURE AND A CAGE-LIKE STRUCTURE PROVIDED WITH SUCH CORNER ELEMENTS

TECHNICAL FIELD OF THE INVENTION

The present invention relates to an element according to the description herein.

Such elements are primarily used to build cage-like structures, such as containers, for transport of larger heavy items, such as larger electric machines, transformers, fuel tanks and the like. The volumes thereof are then several $m^3$ and may even exceed 30 $m^3$. The bottom plane of the structure is then mostly formed by one or several pallets, so that the lower such elements of the structure are then secured to such a pallet. A said cage-like structure typically has board-like members in the form of wooden planks, but may also have one or more such members in the form of for instance plywood boards or board-like members made of plastic.

BACKGROUND ART

An element of this type is already known through FR 2 956 384 B1. The element disclosed in that publication requires considerable work to be carried out for adapting other parts of the structure thereto. It may only be used with said board-like members of one exact thickness, as one example, and as for instance single pieces in a set of wooden planks may have a thickness slightly differing from each other the entire cage-like structure may be unstable.

SUMMARY OF THE INVENTION

The object of the present invention is to provide an element of the type defined in the introduction being improved in at least some aspect with respect to such elements already known, through for instance said document.

This object is according to the invention obtained by providing such an element, which is characterized in that the inner wall portions each comprises a spring member configured to, in a rest state, extend into said space at least partly towards the opposite outer wall portion and to be urged away from this outer wall portion by said first and second board-like members when received between said couple of wall portions while storing potential energy and bear onto and urge said second board-like member to press said first board-like member against said outer wall portion.

Such a design of the element enabling two said first board-like members and two said second board-like members to be firmly held therein by being clamped between each couple of inner and outer wall portions which makes it possible to obtain a very stable cage-like structure allowing secure transport of large heavy items. Another advantage of this design of a said element is that it may be used together with said board-like members of many different thicknesses, as the distance between a couple of inner and outer wall portions is in each case adjusted by the spring members to suit the specific board-like members used. Hence, the board-like members have not to be prepared by any type of machining for being used to build the structure except for being cut to the desired lengths, which means that board-like members of various dimensions may be used. This facilitates the work to build a said cage-like structure at a low cost.

According to an embodiment of the invention each spring member has locking means comprising a retaining part protruding from a main body of the spring member in a direction down towards the bottom portion of the element, which retaining part is configured to, in the active state of the element, bear onto and urge a said second board-like member in a direction at least partly down towards the bottom portion so as to counteract movement of this board-like member away from the bottom portion and out of said space. This design of each spring member and more specifically of the retaining parts thereof gives each spring member extra grip in a surface of a wide side of a said second board-like member so that this board-like member is held in place even without screws.

According to another embodiment of the invention each spring member has locking means configured to, in the active state of the element, interact with locking means on a said second board-like member received in said space so as to fixedly secure said board-like member to the spring member. This design of each spring member facilitates securing of a respective second board-like member in the space of the element without use of separate fastening means, such as screws.

According to another embodiment of the invention the locking means of each spring member comprises a retaining part protruding from a main body of the spring member and configured to interact with locking means of a said second board-like member in the form of a recess on a said wide side of this member by being received in and engage with the recess in a locking position of the retaining part so as to fixedly secure said board-like member to the spring member. The advantage of this embodiment is the same as that of the embodiment just mentioned.

According to another embodiment of the invention each retaining part has a guide surface facing away from and pointing down towards the bottom portion of the element, the guide surface is configured to receive a bottom side of a said second board-like member upon insertion thereof in said space in a direction perpendicular to the bottom portion and to guide this member along the guide surface towards and past a lower edge thereof, whereafter the second board-like member is allowed to be brought straight down towards the bottom portion with the lower edge of the guide surface pressing against a wide side of the second board-like member, and the retaining part is configured to snap out to the locking position once a first edge of the recess on the second board-like member has been brought past the lower edge of the guide surface. This design of each spring member facilitates quick and easy insertion and securing of the second board-like members in the element and thereby a quick assembly of the cage-like structure.

According to another embodiment of the invention the locking means of each spring member comprises a said retaining part in the form of a flap configured to interact with a said recess in the form of an elongated groove arranged at a surface of a said wide side of a said second board-like member and extending perpendicularly to the longitudinal extension thereof.

According to another embodiment of the invention each outer wall portion is provided with an aperture configured to receive a strap to be led to and through a corresponding aperture in a said element arranged at the opposite said plane of the structure and to be tightened for increasing the stability of said structure.

According to another embodiment of the invention the aperture is then located where the outer wall portion is joined to the bottom portion and extends into the bottom portion. This enables comfortable use of straps to further stabilize large structures carrying extremely heavy items when needed.

According to another embodiment of the invention the bottom portion is provided with through-holes enabling securing of this portion by screws to another member of the structure or a member outside the structure. The stability of a cage-like structure built by using elements according to the invention may by this be further increased by securing the elements in this way.

According to another embodiment of the invention each outer wall portion is provided with at least one through-hole enabling securing of a said first board-like member thereto by a screw. The advantage of this embodiment is the same as that of the embodiment just mentioned.

According to another embodiment of the invention each said opening comprises a stop member extending from the bottom portion in parallel with a respective said wall member to form a stop for an end of a said first board-like member introduced through said opening, and the two outer wall portions are connected to each other through the two stop members so that in a said active state of the element an outer recess with a square cross-section as seen perpendicularly to the bottom portion is formed externally of the element along said edge of the structure. This means that the two first board-like members received in the same element will not bear onto each other but onto said stop member, which increases the stability of a corner of a said cage-like structure obtained by use of the element.

According to another embodiment of the invention constituting a further development of the embodiment last mentioned each said stop member has a width in the direction pointing towards the opening associated with the other stop member being identical or substantially identical to the width of said thin side of a said first board-like member to be received in the element.

According to another embodiment of the invention the bottom portion is where each outer wall portion is joined thereto provided with a slot enabling folding of a part of the bottom portion out from the rest of the bottom portion to extend perpendicularly thereto in a direction opposite to the extension of the outer wall portions from the bottom portion. Said part of the bottom portion may when folded out for instance be used as a guide for stacking an item onto the cage-like structure when the element is used at an upper corner of the structure, and when this part of the bottom portion is provided with at least one through-hole enabling securing of this part to a member outside the structure, as in another embodiment of the invention, this part may be used for then securing a lid covering the rest of the structure.

According to another embodiment of the invention all parts of the element are plate-like, and it is then preferred that they are made of one single flat material piece bent to form the element, and this is preferably of metal making the element strong and also easy to produce at a low cost, such as by bending and punching.

The invention also relates to a cage-like structure, such as a container, which is provided with an element according to any of the preceding claims at each of eight said corners thereof.

Further advantages as well as advantageous features of the invention appear from the following description of an embodiment of the invention.

BRIEF DESCRIPTION OF THE DRAWINGS

With reference to the appended drawings, below follows a specific description of an element and a cage-like structure according to an embodiment of the invention cited as examples.

In the drawings.

DETAILED DESCRIPTION OF AN EMBODIMENT OF THE INVENTION

Figure 1:
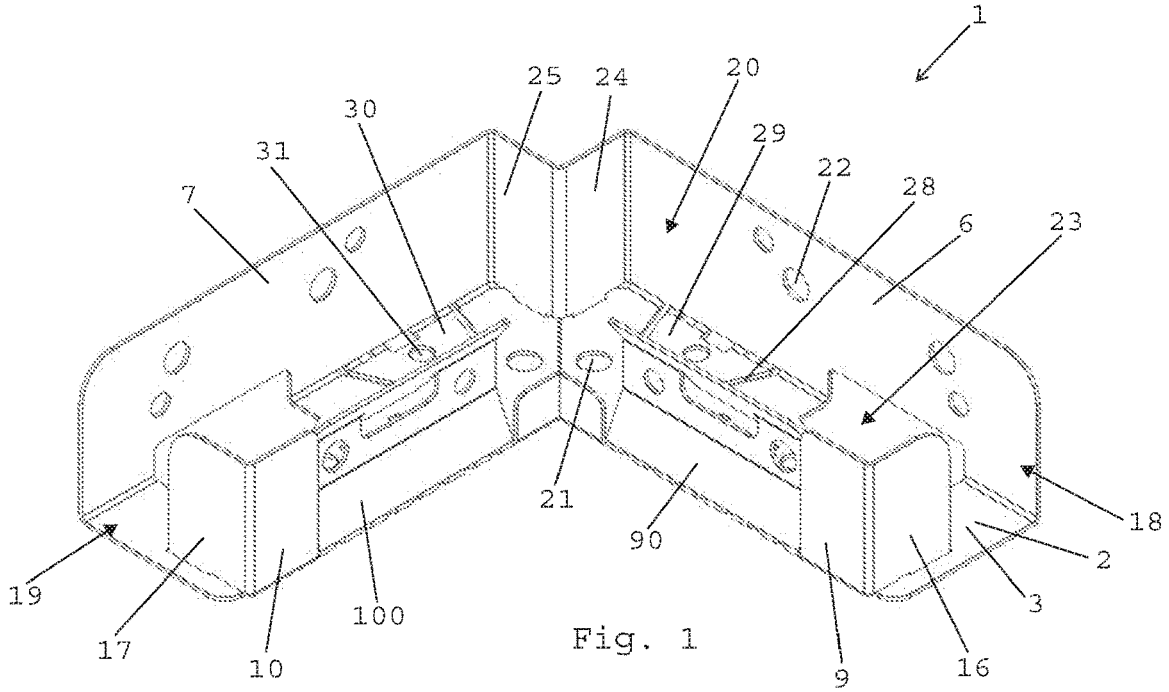
FIG. 1 is a perspective view from above of a front side of an element according to an embodiment of the invention.
Figure 2:
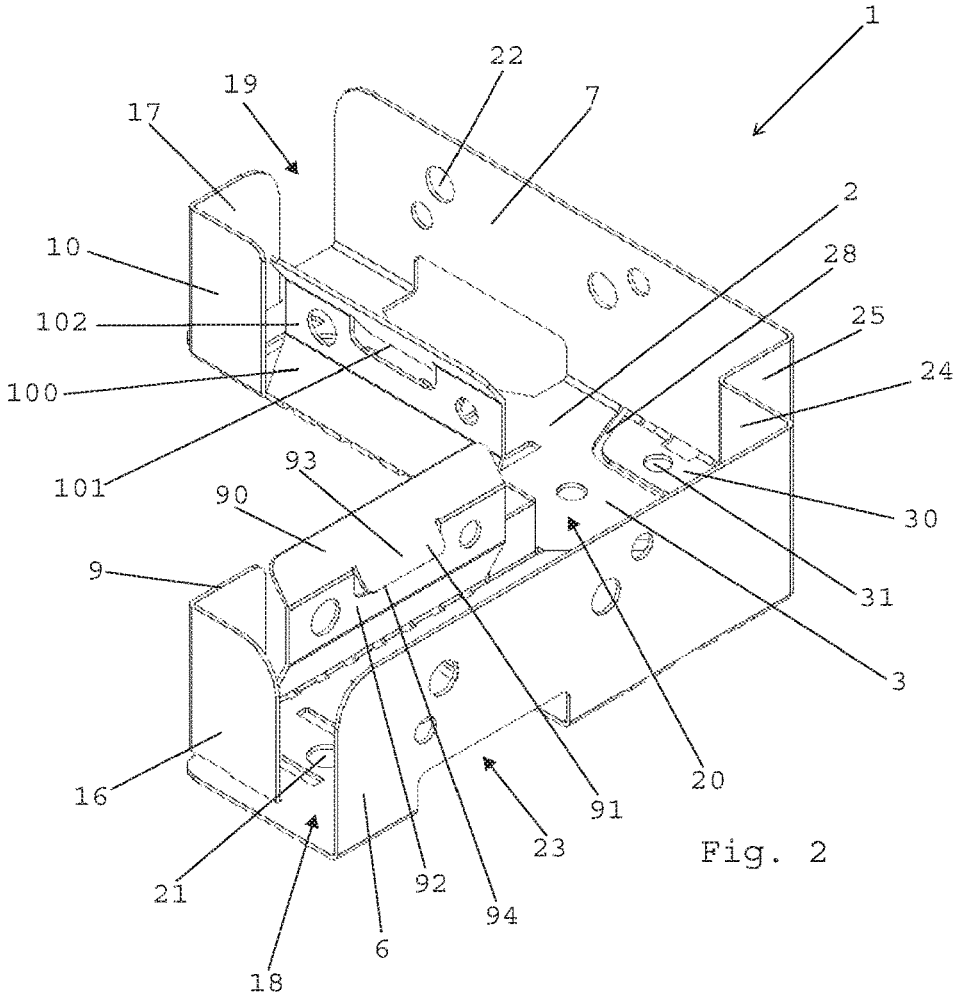
FIG. 2 is a perspective side view from above of the element shown in FIG. 1.
Figure 3:
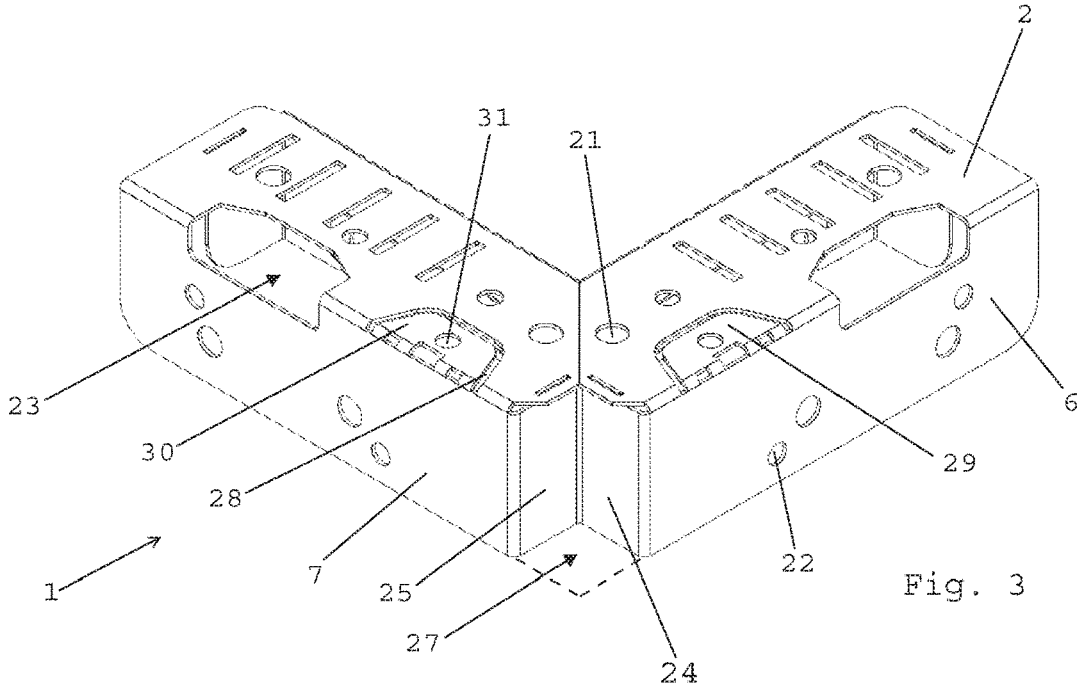
FIG. 3 is a perspective view from below of a back side of the element shown in FIG. 1.

An element 1 according to an embodiment of the invention will now be described while making reference to FIGS. 1-3 and 5. FIGS. 1 and 2 show the element as it will be arranged on for instance a pallet to form a lower corner of a parallelepipedic cage-like structure, as it is in FIG. 5, whereas FIG. 3 shows the element as it will be arranged to form an upper corner of a said structure. The element 1 is made of one single flat material piece of metal bent to form the element as shown in the figures. The element comprises a bottom portion 2 with a flat surface 3 configured to bear on a thin side 4 of two first board-like members 5, such as wooden planks, of the structure meeting each other at the corner and each extending from the corner along a bottom or a top plane to an adjacent corner of the structure as shown in FIG. 4.

Figure 4:
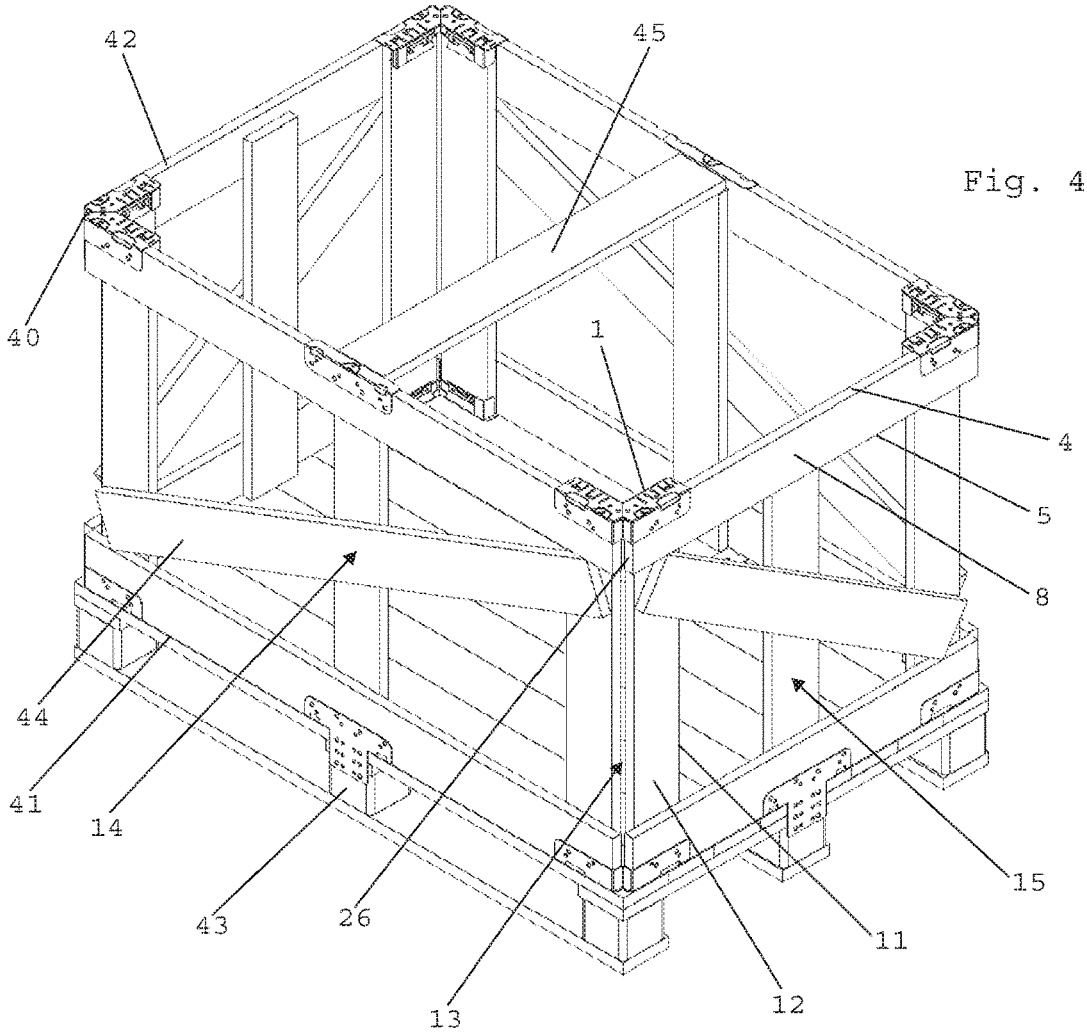
FIG. 4 is a perspective view from above of a cage-like structure according to an embodiment of the invention produced by using the element shown in FIGS. 1-3 in the eight corners of the structure.
Figure 5:
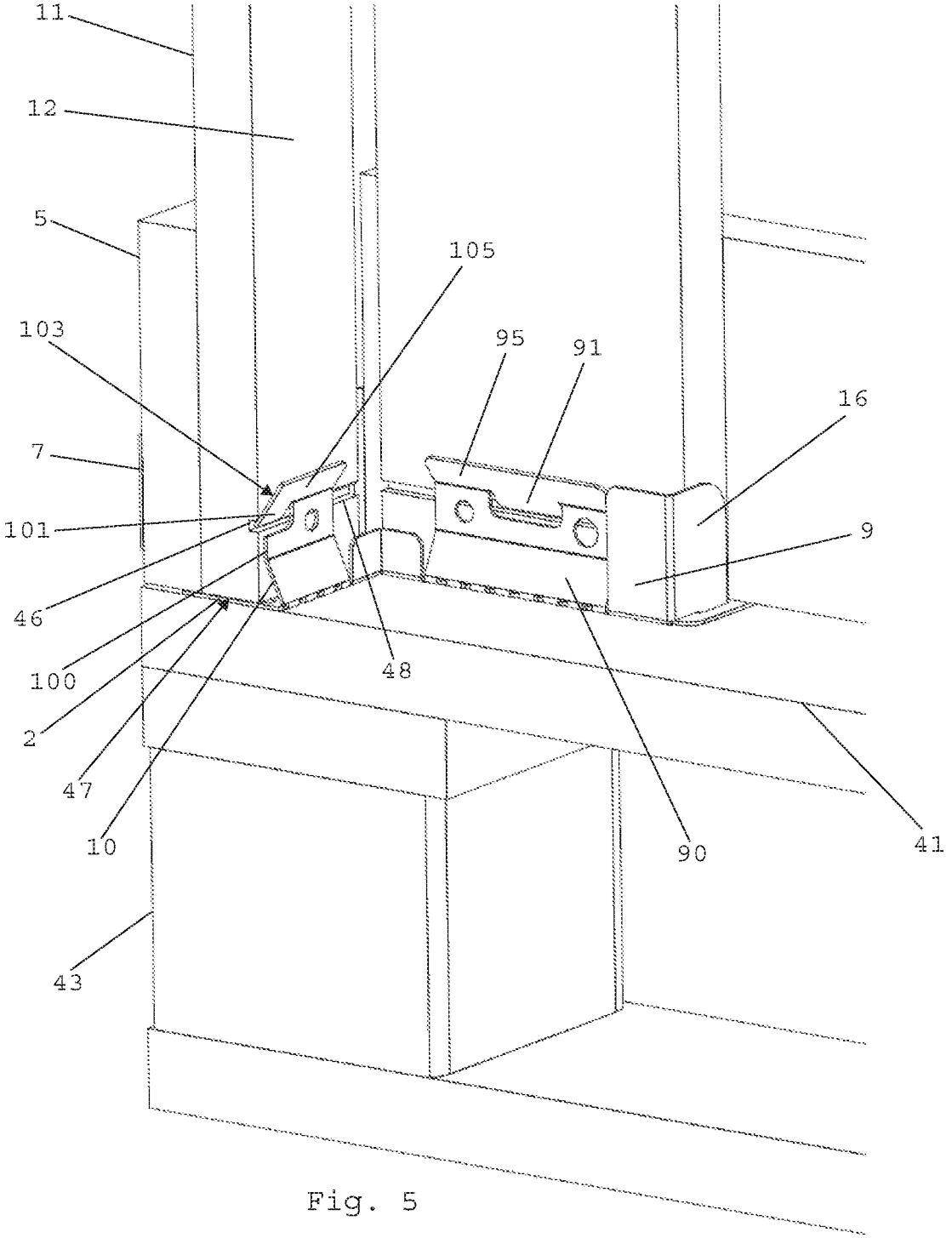
FIG. 5 is an enlarged partly sectional view showing one of the lower corners of the cage-like structure of FIG. 4 from the inside of the structure.

The element 1 has two outer wall portions 6, 7 to be located externally of the structure in the active state of the element, shown in FIGS. 4 and 5, and extending from the bottom portion 2 perpendicularly thereto so as to each form a lateral support to a wide side 8 of a respective said first board-like member 5 received in the element.

Furthermore, the element 1 has two inner wall portions 9, 10 located opposite to the outer wall portions 6, 7 and in an active state of the element extending from the bottom portion 2 mainly in the same direction as the outer wall portions, i.e. each inner wall portion 9, 10 has a general extension which is parallel to the extension of the opposite outer wall portion 6, 7. There is a distance separating each couple of outer 6, 7 and inner 9, 10 wall portions so as to allow a said first board-like member 5 and a second board-like member 11 to be received therebetween, with wide sides 8, 12 of these board-like members bearing on each other. Each such second board-like member 11 is a part of the structure extending along an edge 13 between two adjacent walls 14, 15 of the structure between the bottom plane and the top plane thereof.

The inner wall portions 9, 10 each comprises a spring member 90, 100 configured to, in a rest state (as seen in FIGS. 1 and 2), extend into a space 20 of the element at least partly towards the opposite outer wall portion 6, 7 and to be urged away from this outer wall portion by said first and second board-like members 5, 11 when received between a said couple of wall portions, as seen in FIG. 5, while storing potential energy and bear onto and urge said second board-like member 11 to press said first board-like member 5 against said outer wall portion 6, 7. The first and second board-like members received between a couple of inner 9, 10 and outer 6, 7 wall portions in the active state of the element 1 are thus clamped between these wall portions by the resilient action of the respective spring member 90, 100.

Each spring member 90, 100 has locking means comprising a retaining part 91, 101 in the form of a flap protruding from a main body 92, 102 of the spring member in a direction down towards the bottom portion 2 of the element 1. Each retaining part is configured to, in the active state of the element, bear onto and by the resilient action of the respective spring member urge a said second board-like member 11 in a direction at least partly down towards the bottom portion 2 so as to counteract movement of this board-like member 11 away from the bottom portion and out of said space 20. This design of each spring member 90, 100 and more specifically of the retaining parts 91, 101 thereof gives each spring member extra grip in a surface of a wide side 12 of a said second board-like member so that this board-like member is held in place even without screws.

To facilitate a more secure locking of the second board-like members 11 in the space 20 of the element 1, each retaining part 91, 101 is further configured to interact with locking means of a said second board-like member in the form of a recess 46, namely an elongated groove arranged at the surface of said wide side 12 of the second board-like member 11 and extending perpendicularly to the longitudinal extension thereof. More specifically, each retaining part 91, 101 is configured to be received in and engage with a said recess 46 in a locking position of the retaining part so as to fixedly secure the respective second board-like member 11 to the spring member 90, 100.

Furthermore, each retaining part 91, 101 has a guide surface 93, 103 facing away from and pointing down towards the bottom portion 2 of the element 1. The guide surface is configured to receive a bottom side 47 of a said second board-like member 11 upon insertion thereof in said space 20 in a direction perpendicular to the bottom portion 2 (i.e. from above as seen in FIG. 5) and to guide this member 11 along the guide surface 93, 103 towards and past a lower edge 94 thereof. The second board-like member 11 brought past said lower edge of the guide surface is then allowed to be brought straight down towards the bottom portion 2 with the lower edge of the guide surface pressing against a wide side 12 of the second board-like member. The retaining part 91, 101 is thus configured to automatically snap out to the locking position, i.e. into the recess 46 as seen in FIG. 5, once a first edge 48 of the recess has been brought past the lower edge 94 of the guide surface 93, 103. To release each retaining part 91, 101 from its locking position, the spring member 90, 100 is pushed on an upper surface 95, 105 thereof facing away from the respective second board-like member 11 (see FIG. 5) making the retaining part come out of the recess 46 so that the second board-like member may be moved out of the space 20 of the element 1.

The element 1 also has two wall members 16, 17 each extending from the bottom portion 2 perpendicularly, or at least substantially perpendicularly, to the outer 6, 7 and inner 9, 10 wall portions of a respective couple 6, 9 and 7, 10 of such wall portions to define an opening 18, 19 into the space 20 of the element defined by the wall portions and the wall member. Each such opening 18, 19 is directed along the extension of a said first board-like member 5 to be received in the space 20 with a width of this opening substantially corresponding to the thickness, i.e. the dimension of the thin side 4, of this member so as to form a support for and prevent the second board-like member 11 from leaving the space 20 in the direction of this opening along said plane. Accordingly, such second board-like members will each be held in place and bear on a wall member 16, 17 and an inner wall portion 9, 10.

Furthermore, the bottom portion 2 as well as the outer wall portions 6, 7 are provided with through-holes 21, 22 for securing these portions by screws to other components when desired, such as to a pallet or said board-like members.

Each outer wall portion 6, 7 is also provided with an aperture 23 configured to receive a strap to be led to and through a corresponding aperture in a said element 1 arranged at the opposite of the top plane and the bottom plane of the structure and to be tightened for increasing the stability of the structure. These apertures 23 are located where the outer wall portions 6, 7 are joined to the bottom portion 2 and extend into the bottom portion as clearly visible in FIGS. 1-3 facilitating introduction of a strap into these apertures while running from the aperture along opposite sides of the outer wall portion in the direction perpendicularly to the bottom portion.

Each opening 18, 19 of the element 1 comprises a stop member 24, 25 extending from the bottom portion 2 in parallel with the respective said wall member 16, 17 to form a stop for an end 26 of a first board-like member 5 introduced through the opening. The two outer wall portions 6, 7 are connected to each other through the two stop members 24, 25 so that in an active state of the element, as shown in FIG. 4, an outer recess 27 with a square cross-section as seen perpendicularly to the bottom portion is formed externally of the element 1 along said edge 13 of the structure.

Finally, the bottom portion 2 is where each outer wall portion 6, 7 is joined thereto provided with a slot 28 enabling folding of a part 29, 30 of the bottom portion out from the rest of the bottom portion to extend perpendicularly thereto in a direction opposite to the extension of the outer wall portions from the bottom portion for using this part as a guide for stacking a member onto the cage-like structure or securing a lid onto the structure by using a through-hole 31 therein for applying a screw.

FIG. 4 shows how a cage-like structure may be formed by using elements 1 according to the invention in each corner 40 thereof where a bottom 41 or a top 42 plane of the structure meets two walls 14, 15 of the structure extending perpendicularly to this plane and to each other. It is seen how the elements at the lower corners of the structure may be secured onto a pallet 43 and first board-like members 5 be introduced into the elements to bear against the outer wall portions 6, 7 and second board-like members 11 be introduced therebehind to bear against the inner wall portions 9, 10 and the wall members 16, 17. This is also done at the upper corners of the structure by for instance applying the elements 1 from above onto the second board-like members and introducing the first board-like members from below into the elements and then securing them thereto by screws. Straps may then also be used for increasing the stability of the structure when desired. It is shown how the structure may be further reinforced by applying further board-like members 44, 45 thereto.

The invention is of course not in any way restricted to the embodiments described above but many possibilities to modifications thereof would be apparent to a person with ordinary skill in the art without for that sake departing from the scope of the invention as defined in the appended claims.

The element may have any size, but it is preferred to provide several sizes, such as two sizes with 19 mm and 38 mm opening widths compatible with European and US lumber sizes.

It should be clarified that the flat surface of the bottom portion of the element will be directed upwardly when the element is used in a lower corner of the structure and be directed downwardly to have said board-like members thereunder when the element is used in an upper corner of the structure.

That "each inner wall portion has a general extension which is parallel to the extension of the opposite outer wall portion" means that one or more parts of each inner wall portion may extend in another direction, but each inner wall portion seen as one unit extends in parallel with the opposite outer wall portion, i.e. for instance upwardly as seen in FIGS. 1 and 2. Each inner and outer wall portion may be constituted by one continuous wall section only, or by two or more wall sections spaced apart.

The invention claimed is:

1. An element (1) configured to, in an active state, be arranged in a corner (40) of a parallelepipedic cage-like structure, said cage-like structure having top and bottom planes (42, 41) and walls (14, 15) extending perpendicularly between said top and bottom planes (42, 41), said corner (40) of said cage-like structure located where the bottom (41) or top (42) plane of the cage-like structure meets said walls (14, 15) of the cage-like structure, the element (1) comprising a bottom portion (2) having a flat surface (3) configured to bear on a thin side (4) of two first board-like members (5) of the cage-like structure meeting each other at the corner (4) of the cage-like structure and each said first board-like member (5) of the cage-like structure extending from the corner (40) of the cage-like structure along said plane (41, 42) of the cage-like structure to a respective adjacent corner (40) of the cage-like structure, two outer wall portions (6, 7) configured to be located externally of the cage-like structure in said active state of the element (1) and extending from the bottom portion (2) perpendicularly thereto to each form a lateral support to a wide side (8) of a respective first board-like member (5) received in the element (1) in said active state, two inner wall portions (9, 10) located opposite to the outer wall portions (6, 7) and extending from the bottom portion (2) mainly in the same direction as the outer wall portions (6, 7), each with a distance separating the outer (6, 7) and inner (9, 10) wall portions to receive in said active state, said first board-like member (5) and a second board-like member (11) of said cage-like structure therebetween, with wide sides (8, 12) of said first and second board-like members (5, 11) bearing on each other in said active state, and each said second board-like member (11) of the cage-like structure extending along an edge (13) between two adjacent walls (14, 15) of the cage-like structure from one of said planes (41, 42) of said cage-like structure to the other, and two wall members (16, 17) extending from the bottom portion (2) perpendicularly to the outer (6, 7) and inner (9, 10) wall portions to define an opening (18, 19) into a space (20) of the element (1) defined by the wall portions (6, 7, 9, 10) and said wall members (16, 17), such that an extension of said first board-like member (5) of said cage-like structure is received in said space (20) in said active state, and with a width of said opening (18, 19) substantially corresponding to thickness of a thin side (4) of said first board-like member (5) of the cage-like structure, to form a support for and prevent the second board-like member (11) from leaving said space (20) in the direction of said opening (18, 19) along said plane (41, 42) of the cage-like structure in said active state, wherein the inner wall portions (9, 10) of said element (1) each comprises a spring member (90, 100) configured to, in a rest state, extend into said space (20) at least partly towards the opposite outer wall portion (6, 7) and to be urged away from this outer wall portion (6, 7) by said first and second board-like members (5, 11) when received between said wall portions (6, 7, 9, 10) in said active state, while storing potential energy and bearing onto and urging said second board-like member (11) of said cage-like structure to press said first board-like member (5) of said cage-like structure against said outer wall portion (6, 7) in said active state, and each spring member (90, 100) has locking means comprising a flap (91, 101) bent out from a main body (92, 102) of the spring member (90, 100) and protruding downwardly towards the bottom portion (2) of the element (1), said flap (91, 101) configured to, in the active state of the element (1), bear onto and urge said second board-like member (11) of the cage-like structure in a direction at least partly downwardly towards the bottom portion (2) of the element (1), to counteract movement of said respective second board-like member (11) away from the bottom portion (2) and out of said space (20) of said element (1).

2. An element (1) according to claim 1, wherein each spring member (90, 100) has locking means configured to, in the active state of the element (1), interact with locking means on said second board-like member (11) received in said space (20) to fixedly secure said board-like member (11) to the spring member (90, 100).

3. An element (1) according to claim 2, wherein the flap (91, 101) is configured to interact with locking means of said second board-like member (11) in the form of a recess (46) on said wide side (8) of this member (11) by being received in and engage with the recess (46) in a locking position of the flap (91, 101) to fixedly secure said board-like member (11) to the spring member (90, 100).

4. An element (1) according to claim 3, wherein each flap (91, 101) has a guide surface (93, 103) pointing upwardly away from the bottom portion (2) of the element (1), the guide surface (93, 103) is configured to receive a bottom side (47) of a said second board-like member (11) upon insertion thereof in said space (20) in a direction perpendicular to the bottom portion (2) and to guide this member (11) along the guide surface (93, 103) towards and past a lower edge (94) thereof, whereafter the second board-like member (11) is allowed to be brought straight down towards the bottom portion (2) with the lower edge (94) of the guide surface (93, 103) pressing against a wide side (12) of the second board-like member (11), and the flap (91, 101) is configured to snap out to the locking position once a first edge (48) of the recess (46) on the second board-like member (11) has been brought past the lower edge (94) of the guide surface (93, 103).

5. An element (1) according to claim 3, wherein said flap is configured to interact with said recess (46) which is in the form of an elongated groove arranged at a surface of said wide side (12) of said second board-like member (11), and said elongated groove (46) extending perpendicularly to the longitudinal direction of said second board-like member (11).

6. An element (1) according to claim 1, wherein each outer wall portion (6, 7) is provided with an aperture (23) configured to receive a strap to be led to and through a corresponding aperture in said element (1) arranged at the opposite said plane of the structure and tightened for increasing the stability of said structure.

7. An element (1) according to claim 6, wherein said aperture (23) is located where the outer wall portion (6, 7) is joined to the bottom portion (2) and extends into the bottom portion (2).

8. An element (1) according to claim 1, wherein the bottom portion (2) is provided with through-holes (21) enabling securing of this portion (2) by screws to another member of the structure or a member outside the structure.

9. An element (1) according to claim 1, wherein each outer wall portion (6, 7) is provided with at least one through-hole (22) enabling securing of said first board-like member (5) thereto by a screw.

10. An element (1) according to claim 1, wherein each said opening (18, 19) comprises a stop member (24, 25) extending from the bottom portion (2) in parallel with a respective wall member (16, 17) to form a stop for an end (26) of said first board-like member (5) introduced through said opening (18, 19), and the two outer wall portions (6, 7) are connected to each other through the two stop members (24, 25) so that in said active state of the element (1) an outer recess (27) with a square cross-section extending perpendicularly to the bottom portion (2) is formed externally of the element (1) along said edge (13) of the structure.

11. An element according to claim 10, wherein each stop member (24, 25) has a width in the direction pointing towards the opening (18, 19) associated with the other stop member (24, 25) being identical or substantially identical to the width of said thin side (4) of said first board-like member (5) to be received in the element (1).

12. An element (1) according to claim 1, wherein the bottom portion (2) where each outer wall portion (6, 7) is joined thereto, is provided with a slot (28) enabling folding of a part (29, 30) of the bottom portion (2) out from the rest of the bottom portion (2) to extend perpendicularly thereto in a direction opposite to the extension of the outer wall portions (6, 7) from the bottom portion (2).

13. An element (1) according to claim 12, wherein said part (29, 30) of the bottom portion (2) is provided with at least one through-hole (31) enabling securing of this part (29, 30) to a member outside the structure.

14. A cage-like structure, such as a container, provided with an element (1) according to claim 1 at each of the eight said corners (40) thereof.

* * * * *